US012680258B2

(12) United States Patent
Idda

(10) Patent No.: US 12,680,258 B2
(45) Date of Patent: Jul. 14, 2026

(54) METHOD FOR DESIGNING AND FORMING A RETAINING WALL IN THE GROUND, AND RETAINING WALL

(71) Applicant: BAUER Spezialtiefbau GmbH, Schrobenhausen (DE)

(72) Inventor: Klaus Idda, Schrobenhausen (DE)

(73) Assignee: BAUER Spezialtiefbau GmbH, Schrobenhausen (DE)

( * ) Notice: Subject to any disclaimer, the term of this patent is extended or adjusted under 35 U.S.C. 154(b) by 98 days.

(21) Appl. No.: 18/861,935

(22) PCT Filed: Apr. 26, 2023

(86) PCT No.: PCT/EP2023/060898

§ 371 (c)(1),
(2) Date: Oct. 31, 2024

(87) PCT Pub. No.: WO2023/247094

PCT Pub. Date: Dec. 28, 2023

(65) Prior Publication Data

US 2025/0290265 A1 Sep. 18, 2025

(30) Foreign Application Priority Data

Jun. 24, 2022 (EP) ..... 22180995

(51) Int. Cl.

| | |
|---|---|
| ***E02D 29/02*** | (2006.01) |
| ***E02D 3/12*** | (2006.01) |
| ***E02D 15/08*** | (2006.01) |
| ***E02D 17/06*** | (2006.01) |

(52) U.S. Cl.
CPC ..... *E02D 29/0283* (2013.01); *E02D 3/126* (2013.01); *E02D 15/08* (2013.01); *E02D 17/06* (2013.01); *E02D 2300/0018* (2013.01)

(58) Field of Classification Search
CPC ..... E02D 29/0283; E02D 3/126; E02D 15/08; E02D 17/06; E02D 2300/0018
See application file for complete search history.

(56) References Cited

U.S. PATENT DOCUMENTS

2022/0196000 A1* 6/2022 Butler ..... B28C 5/08

FOREIGN PATENT DOCUMENTS

| | | | | |
|---|---|---|---|---|
| DE | 202019102494 U1 | | 5/2019 | |
| EP | 1452645 B2 | | 5/2013 | |
| EP | 2666911 A1 | | 11/2013 | |
| EP | 3798367 A1 | | 3/2021 | |
| EP | 4477804 A1 | * | 12/2024 | ..... E02D 5/76 |
| KR | 200362565 Y1 | * | 9/2004 | ..... E02D 17/04 |
| KR | 20220066861 A | * | 5/2022 | ..... E02F 3/961 |

OTHER PUBLICATIONS

International Search Report issued in PCT/EP2023/060898; mailed May 25, 2023.
International Preliminary Report on Patentability issued in PCT/EP2023/060898; completed Feb. 7, 2025.

* cited by examiner

*Primary Examiner* — Kyle Armstrong
(74) *Attorney, Agent, or Firm* — Studebaker Brackett PLLC

(57) ABSTRACT

The invention relates to a method for designing and forming a retaining wall in the ground having a required target wall stiffness made of a soil-based mortar, which is produced in the ground by mixing soil material and a cement suspension, and vertically aligned support beams, which are positioned in the soil-based mortar and arranged therein, wherein the arrangement of the support beams is laid-out to have an overall beam stiffness. According to the invention, it is provided that the support beams are arranged such that the laid-out overall beam stiffness is less than the required target wall stiffness, and that, when laying-out and arranging the support beams, an additional stiffness component is added that results from at least one adjacent wall section made of soil-based mortar.

10 Claims, No Drawings

METHOD FOR DESIGNING AND FORMING A RETAINING WALL IN THE GROUND, AND RETAINING WALL

The invention relates to a method for designing and forming a retaining wall in the ground having a required target wall strength made of a soil-based mortar, which is produced in the ground by mixing soil material and a cement suspension, and vertically aligned support beams, which are positioned in the soil-based mortar and arranged therein, wherein the arrangement of the support beams is laid-out to have an overall beam stiffness, according to the preamble of claim 1.

The invention further relates to a retaining wall in the ground having a required target wall strength made of a soil-based mortar, which is produced in the ground by mixing soil material and a cement suspension, and vertically aligned beams, which are positioned in the soil-based mortar and arranged therein to form the retaining wall, wherein the arrangement of the support beams is laid-out to have an overall beam stiffness, according to the preamble of claim 10.

EP 1452645 B2 discloses a method for making a trench wall in the ground, in which a trench wall cutter comprising rotatably driven cutting walls is lowered into the ground, wherein soil material is cleared away and comminuted. The cleared soil material is thoroughly mixed with a hardenable liquid within the cut trench, wherein what is known as a soil-based mortar is formed. Before the soil-based mortar hardens, the trench wall cutter is removed from the cut trench filled with soil-based mortar again. Furthermore, it is possible to insert support beams into the soil-based mortar using a crane before the soil-based mortar hardens to form the retaining wall.

A retaining wall of this kind can act as an excavation enclosure, for example.

A method of this kind for producing a retaining wall in the ground made of a soil-based mortar is also called as CSM™ method.

In principle, it is also known to form a retaining wall or bore wall in the ground made of soil-based mortar in a similar manner by means of a boring and mixing screw, and in particular an arrangement of parallel boring and mixing screws arranged beside one another. In this case, the soil material removed during boring is mixed with a hardenable liquid in the borehole to form a soil-based mortar. In order to achieve a desired load-bearing capacity of the wall, support beams are vertically inserted into the soil-based mortar.

A great advantage of the method for constructing a retaining wall using a soil-based mortar is that hardly any, or ideally no, waste of removed soil material arises which needs to be disposed of. This reduces transport and disposal costs for removed soil material. In addition, a consumption of gravel and sand and therewith associated costs is accordingly reduced, or ideally even avoided altogether.

However, when using soil-based mortar that is produced in situ in a cut trench or a borehole, there is no defined strength value that can be attributed, with regard to a transverse load to which a retaining wall in the ground is subjected. For this load, when constructing retaining walls using soil-based mortar, it is routine to design support beams and arrange them in the retaining wall such that a required target wall stiffness is provided and ensured still by the overall beam stiffness of the positioned support beams alone. The total of the stiffnesses/strengths of the support beams used is thus greater than the required target wall stiffness or overall strength of the retaining wall to be constructed.

The object of the invention is based on to specify a method and a retaining wall by means of which a particularly high level of safety and profitability can be achieved for a retaining wall in the ground.

The object is achieved both by a method having the features of claim 1 and by a retaining wall having the features of claim 10.

Preferred embodiments of the invention are set out in the dependent claims.

The method according to the invention is characterised in that the support beams are arranged such that the designed overall beam stiffness is less than the required target wall stiffness, and in that, when designing and arranging the support beams, an additional stiffness component is added that results from at least one adjacent wall section made of soil-based mortar.

A basic concept of the invention is to design the required support beams with regard to their size, number and arrangement when forming a retaining wall from a soil-based mortar such that its overall beam stiffness formed in total is less than a designed and required target wall stiffness of the retaining wall. As a result, material for support beams can be saved and the work involved in positioning support beams can be reduced. This reduces the work and time therefor required and thus reduces the costs for constructing the retaining wall. Here, the target wall stiffness can in particular be predetermined by a building approval authority or by static specifications for a structure to be built.

This invention is based on the knowledge that, in a retaining wall made of soil-based mortar, the surrounding soil-based mortar demonstrably contributes to the wall stiffness of the retaining wall. In particular, in total, the overall beam stiffness of the positioned support beams can be at least 10%, preferably at least 20%, below the required value for the target wall stiffness of the retaining wall to be formed.

The invention is based on intensive tests and calculations made by the applicant whereby the soil-based mortar contributes a reliable proportion of the stiffness and also the strength of the retaining wall, depending on its configuration.

A preferred embodiment of the invention is that no additional reinforcement elements are introduced into the soil-based mortar other than the support beams. For reinforcement, only the substantially vertically aligned support beams are inserted in the hole in the ground with the soil-based mortar before the soil-based mortar is hardened. Additional crossbeams or cross plates on the support beams can be omitted.

Within the meaning of the invention, support beams are longitudinal profiles or support profiles that are produced by rolling or casting and have a substantially consistent cross-sectional profile. According to an embodiment of the invention, it is particularly preferred for steel beams, in particular having a C profile, an H profile or an I profile, to be positioned as support beams. Support beams of this kind made of steel are relatively cost-effectively and reliably available as standard profiles having a predetermined stiffness and strength.

Another preferred configuration variant of the invention is that the support beams are kept free of connecting elements to the soil-based mortar. In particular, the elongate steel beams can be kept free of screws, hooks or other projections, which would otherwise have to be attached to the elongate support beams in a laborious manner before being introduced into the soil-based mortar.

Another expedient method variant is that the additional stiffness component $M_{c,d}$ on a support beam is determined by the at least one adjacent wall section made of soil-based mortar in accordance with the formula:

$$M_{c,d} = D_{c,d} \times e_{c,d},$$

where: $D_{c,d}=A_{c,x}\times 0.85\times f_{cd}$ where: $f_{c,d}=a_c\times f_{m,k}:\gamma m$ and where:

$D_{c,d}$ is the design compressive force of the soil-based mortar;

the index c (concrete) denotes a variable that is associated with the soil-based mortar;

the index d (design) denotes a rated variable, i.e., during the determination, corresponding partial safety factors were taken into account; and the index x relates to the concrete compressive zone, i.e., herein, to the compressive zone of the soil-based mortar.

Furthermore, γm ("gamma m") is the partial safety coefficient for the material having an order of magnitude of preferably between 1.5-1.8 [-].

fcd is the reduced value of the compressive strength of the building material having an order of magnitude of preferably between 0.5-30 [MPa].

fmk is the non-reduced value of the compressive strength of the building material having an order of magnitude of preferably between 0.5-50 [MPa].

Acx is the surface area of the compression region in cross section having an order of magnitude of preferably between 0.5-3 [$m^2$].

Dcd is the compressive force. The order of magnitude results from the calculation of the above-mentioned values [MN].

ecd is an inner lever arm of Dcd having an order of magnitude of preferably between 0.1-0.5 [m].

According to a development, it is also preferred that the overall beam strength $M_{R,d}$ results from the formula:

$$M_{R,d} = \sum D_{i,d} \times e_{i,z} = D_{c,d} \times e_{c,d} + D_{s,d} \times e_{s,d} + Z_{s,d} \times e_{s,z},$$

where $M_{R,d} \geq M_{E,d}$ and the index designates a variable that is associated with the partial cross section of the support beam;

the index R represents resistance;

the index E represents effects;

M designates moments;

D designates compressive forces and Z designates tensile forces; and e is the inner lever arm.

In principle, the retaining wall in the ground with the soil-based mortar can be produced in any suitable manner. According to an embodiment of the invention, it is particularly expedient for a cut trench to be formed in the ground by cutting, wherein removed soil material is processed in the cut trench by supplying a cement suspension and mixing it therewith to the soil-based mortar. The soil-based mortar is thus formed in situ within the cut trench by mixing the cut-out soil material with supplied cement suspension. In this case, the cement suspension can be supplied to the region of the cutting wheels directly on a trench wall cutter. Here, the cutting wheels can take on multiple functions, namely cutting out the soil material and simultaneously mixing the cut-out soil material with the supplied cement suspension. As a result, in a particularly expedient manner, a soil-based mortar can be made directly in the cut trench.

Another preferred configuration variant of the invention is that a borehole is formed in the ground by boring, wherein removed soil material is processed in the borehole by supplying a cement suspension and mixing it therewith to the soil-based mortar. The borehole can, in particular be made by an earth auger comprising an elongate drilling tool, which comprises a removal apparatus on its underside for removing soil material. The removed soil material can be discharged into a rear region of the borehole by a screw conveyor. In this region, mixing elements projecting radially on a drill string can be arranged, by means of which the drilled-out and comminuted soil material can be mixed with supplied cement suspension to the soil-based mortar. The cement suspension can preferably be supplied through a hollow drill string of the drilling tool and can emerge into the borehole at the lower end of the drill string and/or through outlet openings along the drill string.

Here, a particularly efficient method variant results in that, for forming the retaining wall, a plurality of boreholes are made beside one another in the ground by boring. In this case, the drilling tools can be arranged and configured in parallel with one another such that they make overlapping boreholes such that elongate trenches can be made in the ground.

The invention further comprises a retaining wall in the ground, which is characterised in that the support beams are arranged such that the laid-out overall beam stiffness is less than the required target wall stiffness, and in that the support beams are designed and arranged to have an additional stiffness component that results from at least one adjacent wall section made of soil-based mortar. The retaining wall can in particular be formed by the above-described method according to the invention. The above-described advantages can result here.

In principle, the retaining wall can form a linear or curved wall in the ground. A particularly preferred embodiment of the retaining wall according to the invention is that it is configured to be annular to form an excavation enclosure.

The invention claimed is:

1. A method for designing and forming a retaining wall in the ground having a required target wall stiffness, comprising a soil-based mortar, which is produced in the ground by mixing soil material and a cement suspension, and vertically aligned support beams, which are positioned in the soil-based mortar and arranged therein, wherein the arrangement of the support beams is designed to have an overall beam stiffness, wherein the support beams are arranged such that the laid-out overall beam stiffness is less than the required target wall stiffness, and when designing and arranging the support beams, an additional stiffness component is added that results from at least one adjacent wall section made of soil-based mortar, the additional stiffness component $M_{c,d}$ on a support beam is determined by the at least one adjacent wall section made of soil-based mortar in accordance with the formula:

$$M_{c,d} = D_{c,d} \times e_{c,d},$$

where: $D_{c,d}=A_{c,x}\times 0.85\times f_{cd}$ where: $f_{c,d}=a_c\times f_{m,k}$: $Y_M$ and where:

$D_{c,d}$ is the design compressive force of the soil-based mortar;

the index c (concrete) denotes a variable that is associated with the soil-based mortar;

the index d (design) denotes a rated variable, i.e., during the determination, corresponding partial safety factors were taken into account; and the index x relates to the concrete compressive zone, i.e., here, to the compressive zone of the soil-based mortar.

2. The method according to claim 1, wherein no additional reinforcement elements are introduced into the soil-based mortar other than the support beams.

3. The method according to claim 1, wherein steel beams, in particular having a C profile, an H profile or an I profile, are positioned as support beams.

4. The method according to claim 1, wherein the support beams are kept free of connecting elements to the soil-based mortar.

5. The method according to claim 1, wherein the overall beam strength $M_{R,d}$ results from the formula:

$$M_{R,d} = \sum D_{i,d} \times e_{i,z} = D_{c,d} \times e_{c,d} + D_{s,d} \times e_{s,d} + Z_{s,d} \times e_{s,z},$$

where $M_{R,d} \geq M_{E,d}$ and the index designates a variable that is associated with the partial cross section of the support beam;

the index R represents resistance;

the index E represents effects;

M designates moments;

D designates compressive forces and Z designates tensile forces; and e is the inner lever arm.

6. The method according to claim 1, wherein a cut trench is formed in the ground by cutting, wherein removed soil material is processed in the cut trench by supplying a cement suspension and mixing it therewith to the soil-based mortar.

7. The method according to claim 1, wherein a borehole is formed in the ground by boring, wherein removed soil material is processed in the borehole by supplying a cement suspension and mixing it therewith to the soil-based mortar.

8. The method according to claim 7, wherein, for forming the retaining wall, a plurality of boreholes are formed beside one another in the ground by boring.

9. A retaining wall in the ground, which in particular is formed according to a method according to claim 1, having a required target wall stiffness, comprising a soil-based mortar, which is produced in the ground by mixing soil material and a cement suspension, and vertically aligned support beams, which are positioned in the soil-based mortar and arranged therein to form the retaining wall, wherein the arrangement of the support beams is laid-out to have an overall beam stiffness, wherein the support beams are arranged such that the laid-out overall beam stiffness is less than the required target wall stiffness, and in that the support beams are laid-out and arranged to have an additional stiffness component that results from at least one adjacent wall section made of soil-based mortar.

10. The retaining wall according to claim 9, wherein the retaining wall is configured to be annular to form an excavation enclosure.

* * * * *